United States Patent [19]

Costa

[11] 3,980,194

[45] Sept. 14, 1976

[54] SAFETY CLOSURE CAP FOR A CONTAINER HAVING A NECK PORTION

[76] Inventor: Allan Costa, Melville Park Road, Melville, N.Y. 11746

[22] Filed: Jan. 22, 1976

[21] Appl. No.: 651,286

[52] U.S. Cl. ..... 215/223; 215/206; 215/224; 215/350

[51] Int. Cl.[2] ..... B65D 55/02; B65D 85/56; A61J 1/00

[58] Field of Search ..... 215/206, 216, 223, 224, 215/350

[56] References Cited

UNITED STATES PATENTS

| | | | |
|---|---|---|---|
| 3,612,325 | 10/1971 | Williams | 215/350 X |
| 3,871,662 | 3/1975 | Hepp et al. | 215/223 |
| 3,901,401 | 8/1975 | Lynn et al. | 215/223 |

*Primary Examiner*—George T. Hall
*Attorney, Agent, or Firm*—Hane, Sullivan & Spiecens

[57] ABSTRACT

There is disclosed a safety closure cap for use with a bottle or other container having a neck portion. The closure cap is made of an elastically deformable or expandable synthetic plastic material. The neck portion of the bottle has on its outside a ring-shaped rib flattened at a portion of its circumference. The inside of the skirt of the cap has thereon several radially inwardly protruding lugs. These lugs can be forced to pass the rib on the neck portion in any angular position of the cap relative to the bottle neck by applying axially directed pressure to the closure cap thereby effectively locking the cap to the bottle. There is further provided on the inside of the cap a liner of moisture-absorbing material which is held in position by circumferentially spaced further lugs. The lugs on this skirt coacting with the rib are so disposed that when they are forced past the rib on the bottle neck, they also cause the liner to be pressed against the top rim of the neck thereby effectively sealing the bottle against the ingress of moisture and dust particles. Removal of the cap from the bottle neck can be effected only by placing the cap in an angular position in which one of the locking-effecting lugs is in axial alignment with the flattened portion on the rib on the bottle neck. In this position, the respective lug is not retained by the rib, thereby making it possible to pull off the cap by applying a moderate upper pull thereto at the point at which the flattened rib portion and the respective locking lug are in alignment.

9 Claims, 12 Drawing Figures

FIG. 1
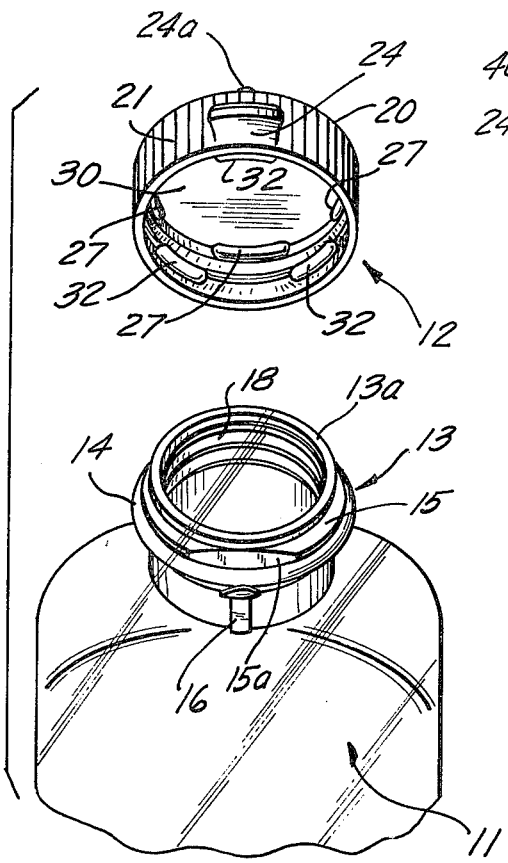
FIG. 4A
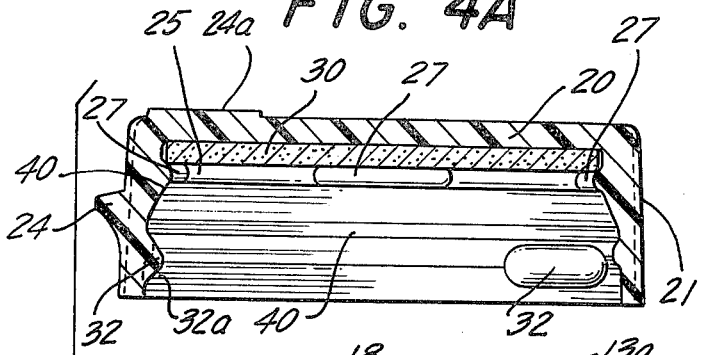
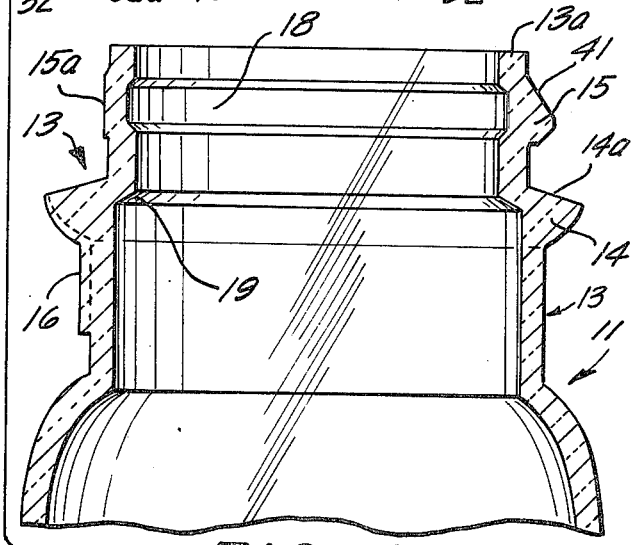
FIG. 4B
FIG. 2
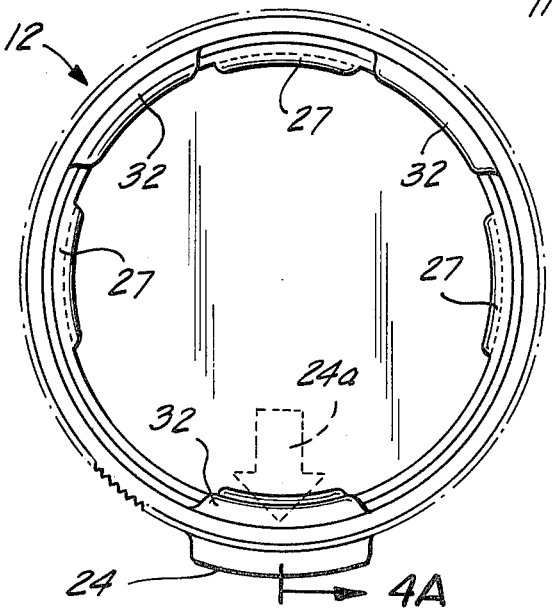
FIG. 3
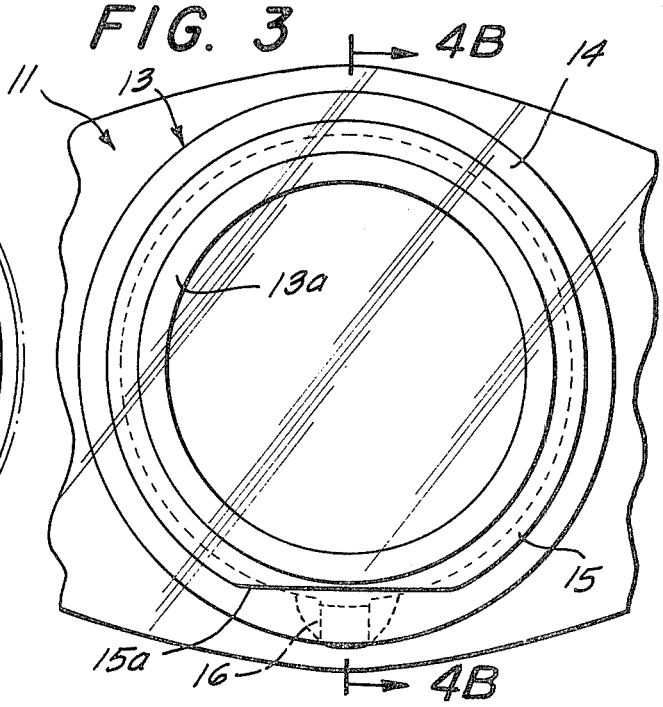

SAFETY CLOSURE CAP FOR A CONTAINER HAVING A NECK PORTION

The invention relates to a child-proof or safety closure device for closing or opening a container and, more particularly, to a child-proof closure device for opening or closing a container having a coacting neck portion such as a bottle.

BACKGROUND

It has been found that serious health damage and even death of young children are far from rare by playing of children with containers such as bottles, cans, etc., containing pharmaceutical preparations and then eating such preparations, the more so as they often appear to be similar to candy and sugarcoated, and also by playing with containers filled with liquids or powders as used in households such as detergents, powerful solvents, bleaches, etc. Injuries caused by opening of containers with a potentially harmful content have reached such alarming proportions that a Poison Prevention Packaging Act was enacted in 1970. This Act states that there is a need for providing special packaging to protect children from serious personal injury or illness resulting from handling, using or ingesting household substances which may be toxic or at least dangerous, such as certain medicines, detergents, drain cleaners, insect killers, etc. As a result of this Act, various types of so-called child-proof closures have been developed and are now in general use.

There are three types of such caps available which have in common that at least two coordinated manipulating steps must be taken to remove the closure cap — one type requires exerting and maintaining strong manual pressure in axial direction between a drive member and the closure cap proper to permit opening or closing of the latter; the second type requires the application of powerful radial pressure upon the drive member for squeezing teeth on the closure cap and the drive member into rotation transmitting engagement, and the third type requires placement of the drive member into accurate rotational register with the closure cap. While the required axial or radial pressure which must be maintained until the closure cap is screwed off or on may prevent opening of a container by a young child, it also makes the use of this type of closure device physically difficult, if not impossible, to use by very many adult persons. Particularly, women often do not have the necessary physical strength to manipulate closure devices of this type and people whose fingers have lost their dexterity due to arthritic or rheumatic stiffness also will find it difficult if not impossible to open a bottle closed by a child-proof closure device, and just such persons have the need of opening and closing containers filled with drugs which they must use. The type which requires placement of the drive member and the closure cap into exact register is difficult to handle if the light conditions are not very good and for persons who have poor eyesight; usually the markings on the drive member and the closure cap are very tiny and often pale so that they are difficult to see.

The present invention relates to the type which requires placement of the closure cap in a specific rotational position relative to the associated bottle or other container for removal of the cap, but permit locking of the cap to the bottle in any rotational position relative to the bottle.

THE INVENTION

It is a broad object of the invention to provide a novel and improved child-proof closure device which combines safety against opening of a bottle or other container having a neck portion by a young child with extremely simple manipulation and which does not require considerable physical strength or dexterity.

Another object of the invention is to provide a novel and improved closure cap-bottle combination which when locked together effect a dust and moisture proof sealing of the bottle and are secured against opening by a young child yet can be opened by a mature person without requiring particular skill or strength.

Still another object of the invention is to provide a novel and improved closure cap-bottle combination which is relatively simple in structure, can be produced by typical mass-production techniques, can be easily locked but requires for opening the performance of sequential steps that do not present any difficulties as to skill or strength to a mature person, but makes it very unlikely that a child will accurately perform the sequence of steps required for removal of the closure cap.

A still further object of the invention is to provide a novel and improved closure cap-bottle combination in which the cap is locked to the bottle by pressing the cap toward the bottle in axial direction and in any angular position of the cap. Such pressure is applicable either by holding the bottle and pressing down the cap, or by applying the axial pressure by holding the cap and pressing the bottle against the cap. This makes it more convenient for persons who are handicapped as to the use of their fingers as it is obviously easier for such persons to grip the bottle than the much smaller closure cap.

SUMMARY OF THE INVENTION

The aforepointed out objects, features and advantages, and other objects, features and advantages which will be pointed out hereinafter are obtained by providing a bottle or another container having a neck portion the outside of which is formed with a radially protruding ring-shaped rib including a flattened portion and by further providing a closure cap with a top wall and a skirt extending therefrom, at least the skirt of the cap being made of an elastically expandable or deformable material such as a suitable synthetic plastic material, for instance polyethylene. The skirt of the cap has on its inside severally radially inwardly protruding elongate lugs which are circumferentially spaced and disposed in a plane parallel to the top wall of the cap. The cap is further provided on its inside with a moisture-absorbing liner held in position by circumferentially spaced apart further lugs radially inwardly protruding from the inside of the skirt.

The dimensions of the rib on the bottle neck and of the first-mentioned lugs and the locations of the rib and these are so correlated that upon application of an axial pressure on the closure cap toward the bottle neck, said lugs will be forced past the rib and underlie the same, thereby locking the cap to the bottle. The dimensions and locations of the rib and the locking lugs are further so correlated that upon forcing the locking lugs into the underlying position, the liner is pressed against the top edge of the bottle neck thereby effectively sealing the bottle against ingress of moisture and dust particles.

Removal of the cap from the bottle can be effected only by placing the cap in an angular position in which one of the locking lugs is in axial registry with the flattened portion of the rib on the bottle neck. As a result, the locking lug in alignment with the flattened rib portion is no longer locked by the rib. Hence, by applying a moderate upward pull to the cap at the portion at which the respective locking lug is in alignment with the flattened rib portion leverage can be easily applied which is sufficient to force the still locked lugs past the rib on the bottle neck so that the cap can be readily removed from the bottle.

BRIEF DESCRIPTION OF THE INVENTION

In the accompanying drawing, a preferred embodiment of a safety closure cap and of a bottle according to the invention is shown by way of illustration and not by way of limitation.

In the drawing:

FIG. 1 is a perspective exploded view of a bottle and a safety closure cap attachable thereto;

FIG. 2 is a view upon the bottom side of the closure cap;

FIG. 3 is a top view upon the bottle;

FIGS. 4A and 4B are exploded sectional views of the bottle and the closure cap attachable thereto; FIG. 4A being a section along line 4A—4A of FIG. 2, and FIG. 4B being a section along line 4B—4B of FIG. 3;

DETAILED DESCRIPTION OF THE INVENTION

Figure 7:
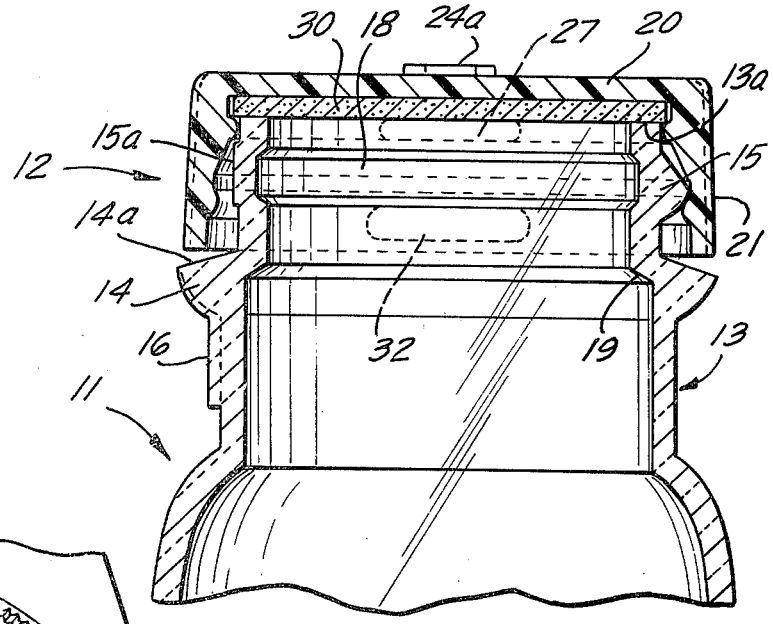
FIG. 7 is a section taken on line 7—7 of FIG. 5.

The invention is broadly directed to a combination of a bottle or other container having a neck portion and of a closure cap which can be locked to the neck portion of the bottle in any angular position relative thereto but can be removed from the bottle only by first rotating the cap into a predetermined angular position relative to the neck portion and then applying a moderate upward pull to the cap. Locking of the cap protects the contents in the bottle against ingress of dust particles and moisture and against access to the contents in the bottle by a child.

Referring now in detail to the drawing figures, and first to FIGS. 1 to 4B, these figures show a bottle 11 and a closure cap 12. The bottle has a neck portion 13 and may be made of a synthetic plastics material or glass. Of course, the safety closure cap may also be used with a can or jar provided that the can or jar has a neck portion 13, as will be more fully described hereinafter.

The closure cap is made generally by molding of a suitable elastically expandable synthetic plastics material such as polyethylene.

Referring now to FIGS. 3 and 4B, the neck portion 13 of the bottle comprises a circumferential rib 14, the top side 15*a* of which is slanted to facilitate removal of the cap, as will be more fully explained hereinafter. The part of the neck portion extending above rib 14 has on its outside a circumferential rib 15 which is uninterrupted except for a flattened portion 15*a*, best seen in FIG. 3. This flattened rib portion may be inwardly slanted toward the upper edge of the neck portion. There is provided on the neck portion in axial alignment with the flattened rib portion and below rib 14 a headed arrow 16. This arrow is a marker facilitating placement of the cap into the angular position for removal of the cap, as will be more fully explained hereinafter.

FIG. 4B shows at the left side the part of the neck portion where rib 15 is flattened.

The inside of the neck portion is formed with a circumferential groove 18, radially adjacent to rib 15, as it is clearly shown in FIG. 4B. There is also provided a set-off 19 on the inner side of the neck portion adjacent to rib 14.

The closure cap as shown in FIGS. 2 and 4A has a top wall 20 from which extends integral therewith a skirt 21. The outside of the skirt is smooth except for a circumferentially elongate protrusion 24 which serves as a grip and marker facilitating separation of the cap from the bottle, as will be more fully described hereinafter. On the inside of the cap there is provided a circumferential groove 25 which is adjacent to the inside of top wall 20 but axially spaced therefrom. Within the groove are provided several circumferentially spaced preferably elongate lugs 27 which radially protrude from groove 25, four such lugs being shown. These lugs serve as supports for a liner 30 which is tightly held by the lugs against the inside of top wall 20 of the closure cap. This liner is made of a compressed fiber or other material suitable to absorb moisture which may penetrate into the bottle. Liner 30 is in tight sealing contact with the top edge 13a of the neck portion when the closure cap is locked to the neck portion, thereby protecting the contents of the bottle against ingress of moisture. The inside of the skirt below lugs 27 is formed with several radially protruding and circumferentially spaced elongate lugs 32, three such lugs being provided and are best shown in FIG. 2. These lugs 32 are designed to coact with rib 15 on the outside of neck portion 13 when the cap is to be locked to the bottle neck. For this purpose, the lower part 32*a* of the lugs is shaped to coact in locking engagement with ribs 15, as will be more fully described hereinafter. There is further provided on the inside of the skirt intermediate of lugs 37 and 32 a circumferential groove 40 in the skirt. The top side 14*a* of rib 14 on the neck portion of the bottle is slanted to facilitate removal of the closure cap as will be apparent from the subsequent description.

Figure 5:
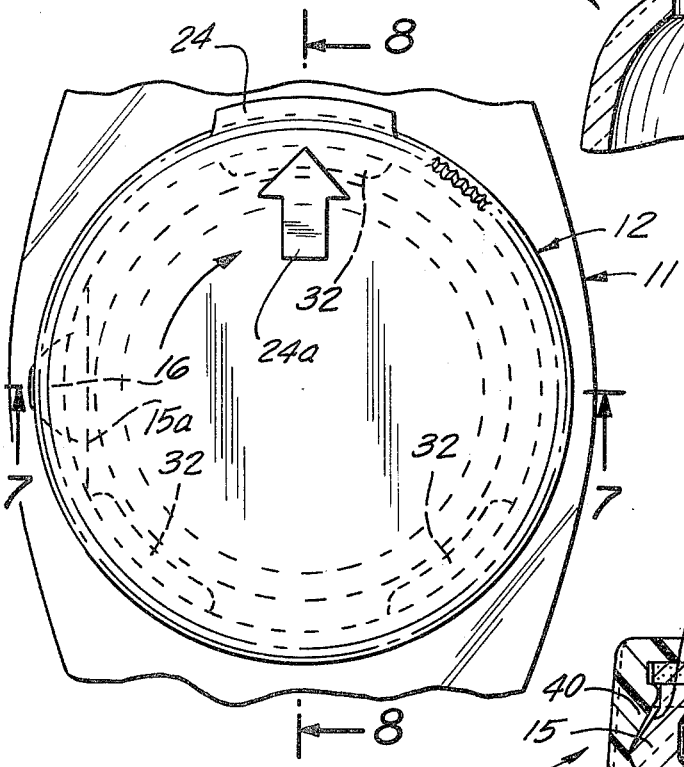
FIG. 5 is a top view upon the closure cap attached to the bottle and in its position locked to the bottle.
Figure 8:
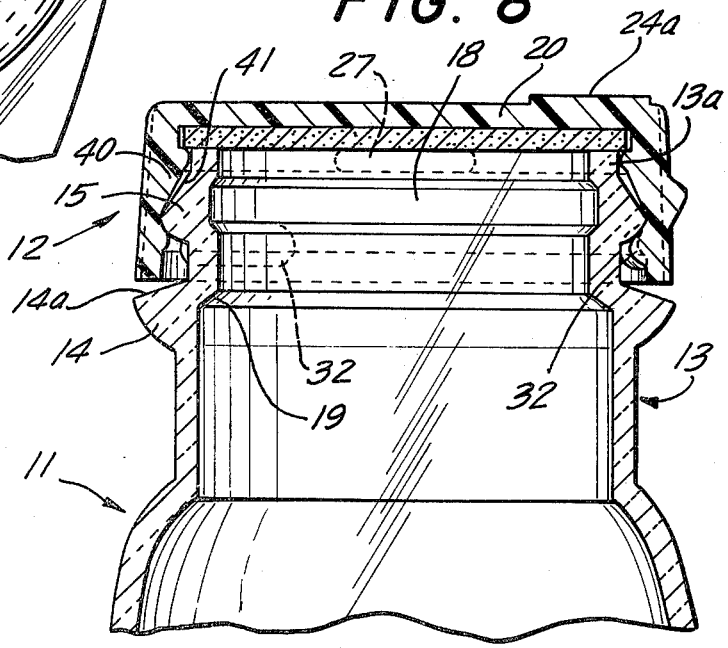
FIG. 8 is a section taken on line 8—8 of FIG. 5.

FIGS. 5, 7 and 8 show the cap applied to the neck portion and in its locked position, that is, in the position in which the cap cannot be detached from the bottle. Referring to FIG. 5, this figure shows that none of the three lugs 22 is in axial registry with the flattened portion 15*a* of rib 15. Accordingly, all three lugs 32 are underlying the rib 15. As it is shown in FIGS. 7 and 8, the lugs abut against the more steeply slanted lower side of rib 15. The axial distances between the lower side of rib 15 and thus also of the upper side of lugs 32 and the inside of top wall 20 of the closure cap are such that the moisture-absorbing liner 30 supported by lugs 27 is tightly pressed against the top rim 13*a* of the neck portion. As a result, the liner effectively seals off the bottle against ingress of dust and moisture. FIGS. 7 and 8 also show that the outer wall surface of the upper side of rib 15 on the neck portion and the wall portion between the upper side of lugs 22 and the adjacent inner side of the skirt are slanted and close to each other, thereby further effecting sealing of the closure cap to the bottle.

Attachment of the closure cap to the neck portion of the bottle can be effected in any angular position of the closure cap relative to the top of the neck portion by fitting the closure cap upon the neck portion and then applying a downwardly directed pressure upon the top wall 20 of the closure cap. As a result of such pressure, the elastically expandable skirt of the closure cap will yield radially outwardly and eventually permit lugs 32 to snap past rib 15 on the neck portion. This final position of the closure cap is clearly shown in FIGS. 7 and 8. As previously indicated, FIG. 7 shows on its left side the portion of the bottle neck at which rib 15 is flattened, while the right hand side shows a section of rib 15 in its radially protruding configuration.

FIG. 8 shows on both sides a section through complete portions of rib 15.

As previously stated, none of lugs 22 shown in FIGS. 5, 7 and 8 is in registry with the flattened rib portion 15*a*. As a result, the cap is locked to the neck at three areas so that it is practically impossible, at least for a young child, to pull the closure cap off the neck portion.

Figure 9:
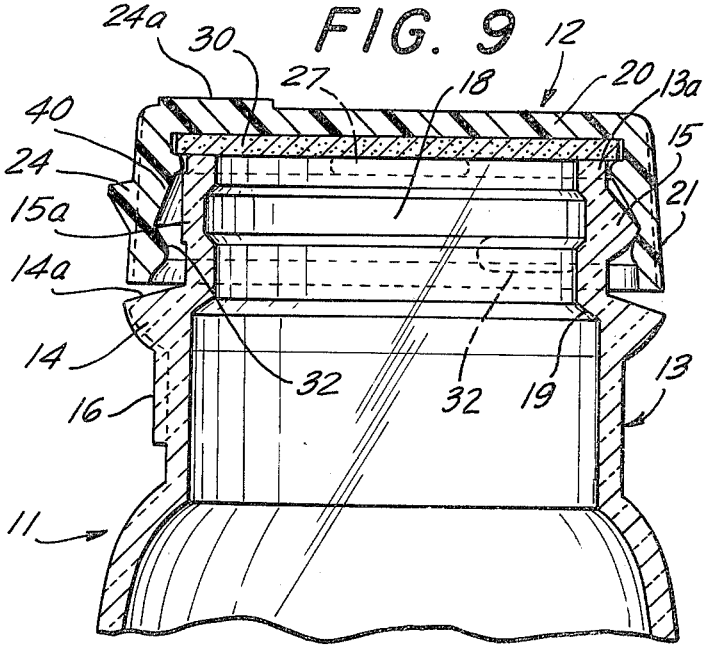
FIG. 9 is a section taken on line 9—9 of FIG. 6.
Figure 6:
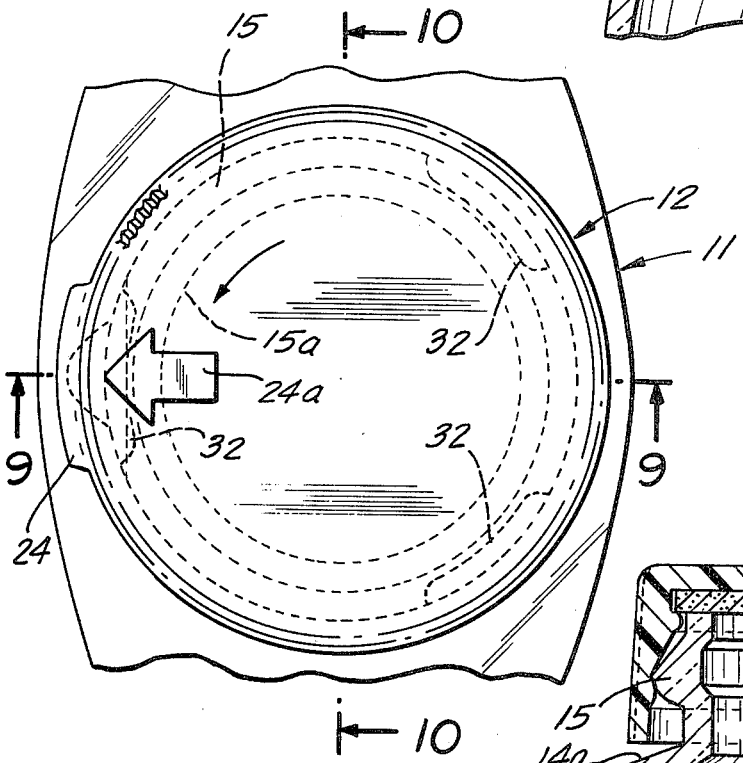
FIG. 6 is a top view upon the closure cap attached to the bottle but in its position for removal of the cap from the bottle.
Figure 10:
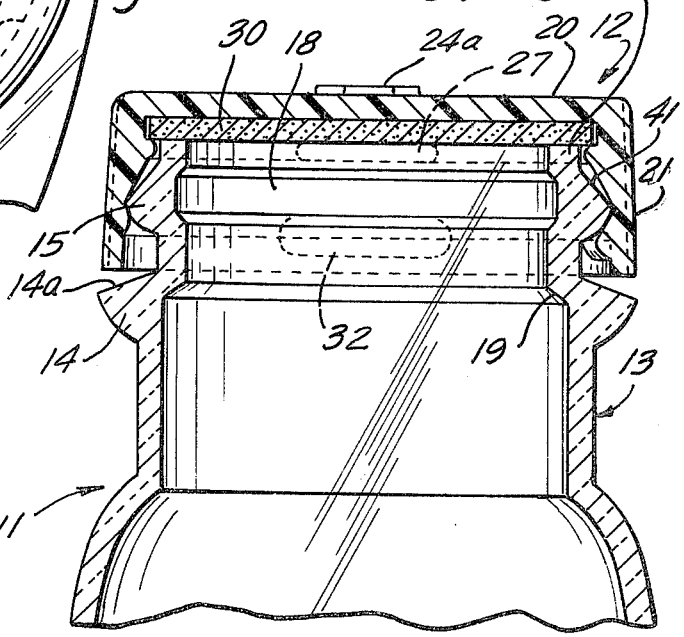
FIG. 10 is a section taken on line 10—10 of FIG. 6.

Referring now to FIGS. 6, 9 and 10, these figures show the closure cap in an angular position relative to the neck portion in which the flattened portion 15*a* of rib 15 is in alignment with one of lugs 32. Such alignment is effected by simply turning the closure cap relative to the bottle or viceversa until arrow 16 on the neck portion is in axial alignment with marker or tab 24 on the outside of the skirt of the closure cap. To effect such alignment, the closure cap as shown in FIG. 6 has been turned through an angle of 90° in counterclockwise direction in comparison with the relative angular position of the cap as shown in FIG. 5. Of course, the cap may be placed in any angular position other than the one shown in FIG. 5.

The closure cap is now ready for removal from the neck portion. Such removal is effected by pulling the cap upwardly at the portion indicated by arrow 16 and an arrow 24*a* on marker 24. Such upward pull can be conveniently applied by inserting a finger nail between the end of the skirt and rib 14 on the neck portion. The slant of surface 14*a* of rib 14 facilitates such insertion. A moderate upward pull will cause the two lugs 32 to snap past rib 15. As it is evident, due to the flattening of rib 15 the respective lug 32 is not restrained by rib 15. Accordingly, even a moderate upward pull will exert considerable leverage on the two remaining lugs 32 held by the full portions of rib 15 so that they will snap over this rib.

Liner 30 will be retained by lugs 27 as these lugs are not affected by snapping the two held lugs past rib 15.

Figure 11:
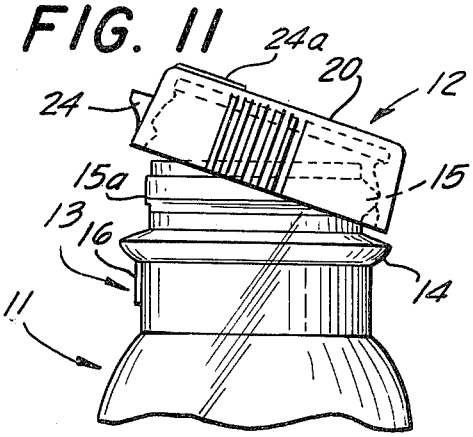
FIG. 11 is a view showing the closure cap partly lifted off of the bottle.

FIG. 11 shows cap 12 partly pulled up from the neck of bottle 11. In the position of FIG. 11, the two held lugs 32 have just been pulled past rib 15 so that the cap can be fully lifted up without further resistance.

While the invention has been described in detail with respect to a certain now preferred example and embodiment of the invention, it will be understood by those skilled in the art, after understanding the invention, that various changes and modifications may be made without departing from the spirit and scope of the invention, and it is intended, therefore, to cover all such changes and modifications in the appended claims.

What is claimed is:

1. A combination of a container having an elongate neck portion providing access to the space within the container and a safety closure cap for selectively opening and closing the neck portion, said combination comprising:

a container made of essentially rigid material and having at its upper end a neck portion of circular configuration, said neck portion having on its outside a radially protruding rib of generally triangular cross-sectional configuration encircling the neck portion except for a flat portion subtending the peripheral outline of the rib;

a closure cap having a circular top wall and an elastically deformable skirt extending therefrom, said skirt having on its inner surface a plurality of radially inwardly protruding first lugs disposed circumferentially spaced in a plane parallel to said top wall;

a plurality of radially inwardly protruding second lugs disposed circumferentially spaced in a plane intermediate the plane of the first lugs and parallel thereto;

a circular liner of form-retaining, moisture-absorbing material between the top wall and the second lugs supported by the latter, the diameter of said liner being substantially equal to the outer diameter of the neck portion at its top edge;

the radial outer width of the neck portion and the radial inner width of the skirt being correlated to define therebetween an annular gap and the maximal radial width of the rib on the neck portion and the inner radial width of the first lugs being correlated with each other and the width of the gap so that the rib and the first lugs overlap but can pass each other in either direction upon elastic deformation of the first lugs by applying axial pressure to the cap and the neck portion toward each or away from each other, placement of all the first lugs into positions underlying the rib relative to said top wall locking the cap to the neck portion and holding said liner in sealing engagement with the top edge of the neck portion and placement of any one of the first lugs in axial alignment with the flat portion of said rib releasing the respective first lug from the rib thereby permitting removal of the cap from the neck portion by applying an upward pull to the cap at the part thereof aligned with the flat portion of the rib on the neck portion.

2. A safety closure cap for selectively opening and closing a container made of essentially rigid material having a neck portion of circular configuration, which has on its outside a radially protruding rib encircling the neck portion except for a flat portion subtending the peripheral outline of the rib, said closure cap comprising:

a circular top wall and an elastically deformable skirt extending therefrom, said skirt having on its inner surface a plurality of radially inwardly protruding first lugs disposed circumferentially spaced in a plane parallel to said top wall;

a plurality of radially inwardly protruding second lugs disposed circumferentially spaced in a plane intermediate the plane of the first lugs and parallel thereto; and a circular liner of form-retaining, moisture-absorbing material between the top wall and the second lugs supported by the latter, the diameter of said liner being substantially equal to the outer diameter of the neck portion at its top edge;

the radial outer width of the neck portion and the radial inner width of the skirt being correlated to define there between an annular gap and the maximal radial width of the rib on the neck portion and the inner radial width of the first lugs being correlated with each other and the width of the gap so that the rib and the first lugs overlap but can pass each other in either direction upon elastic deformation of the first lugs by applying axial pressure to the cap and the neck portion toward each or away from each other, placement of all the first lugs into positions underlying the rib relative to said top wall locking the cap to the neck portion and holding said liner in sealing engagement with the top edge of the neck portion and placement of any one of the first lugs in axial alignment with the flat portion of said rib releasing the respective first lug from the rib thereby permitting removal of the cap from the neck portion by applying an upward pull to the cap at the part thereof aligned with the flat portion of the rib on the neck portion.

3. The combination according to claim 1 wherein the axial length of the skirt wall between the first lugs and the liner is such that upon placement of the first lugs in the position underlying the rib on the neck portion said liner is held in pressure engagement with the top edge of the neck portion thereby effecting tight sealing of the container by the cap.

4. The combination according to claim 1 wherein the lower side of the rib on the neck portion and the upper side of each of the first lugs on the skirt are complementary shaped so that said sides are substantially in engagement with each other when the first lugs are placed in said underlying position.

5. The combination according to claim 4 wherein the upper side of the rib on the neck portion is inwardly slanted and terminates at about the plane in which the second lugs are located when the closure cap is locked to the neck portion.

6. The combination according to claim 1 and comprising a second rib encircling the neck portion below the first rib, said second rib being disposed at a level clear of the end of the skirt when the closure cap is fitted upon the neck portion in its locking position.

7. The combination according to claim 6 wherein the upper surface of the second rib is flat and downwardly slanted, said slanted surface together with the end of the skirt defining a narrow annular gap between the end of the skirt thereby facilitating application of an upward pull upon the closure cap for removal.

8. The combination according to claim 1 and comprising marker means on the outside of the skirt in radial alignment with one of said first lugs and marker means on the outside of the neck portion in axial alignment with the flat portion of the rib on said neck portion whereby placement of the closure cap in an angular position in which said marker means are in axial alignment the respective first lug in clear of the rib on the neck portion thus permitting upward pulling of the cap to remove the same from the neck portion.

9. The combination according to claim 8 wherein the marker means on the skirt includes an outwardly protruding grip.

* * * * *